US005802953A

United States Patent [19]

Nakamura

[11] Patent Number: 5,802,953

[45] Date of Patent: Sep. 8, 1998

[54] POWER TILT CYLINDER DEVICE

[75] Inventor: Tamotsu Nakamura, Saitama, Japan

[73] Assignee: Showa Corporation, Gyoda, Japan

[21] Appl. No.: 821,066

[22] Filed: Mar. 20, 1997

[30] Foreign Application Priority Data

Mar. 22, 1996 [JP] Japan ..... 8-091755

[51] Int. Cl.[6] ..... F15B 11/08; F01B 11/02

[52] U.S. Cl. ..... 91/422; 92/85 R; 92/181 P; 92/255

[58] Field of Search ..... 92/85 R, 181 R, 92/181 P, 255; 91/422

[56] References Cited

U.S. PATENT DOCUMENTS

| | | | |
|---|---|---|---|
| 3,448,658 | 6/1969 | Arnes | 92/181 R X |
| 4,242,946 | 1/1981 | Toliusis | 92/85 R X |
| 4,497,197 | 2/1985 | Giardino et al. | 92/85 R X |
| 4,509,409 | 4/1985 | Reeves | 92/181 P X |
| 4,932,313 | 6/1990 | Gutknecht | 92/181 R |
| 5,341,723 | 8/1994 | Hung | 92/181 P X |
| 5,437,339 | 8/1995 | Tanaka | 92/85 R X |

FOREIGN PATENT DOCUMENTS

| | | |
|---|---|---|
| 601097 | 7/1985 | Japan . |
| 554479 | 12/1993 | Japan . |

*Primary Examiner*—Hoang Nguyen
*Attorney, Agent, or Firm*—Dvorak & Orum

[57] ABSTRACT

In a power tilt cylinder device 100, a hydraulic fluid is supplied to the opposite piston side space 22B of a free piston 25, in the upper limit position of upward tilting, which is performed for discharging the hydraulic fluid from the first chamber 21, an operation valve 62 is pushed open by a rod guide 18A, and a flow passage 64 directed from the opposite piston side space 22B of the free piston 25 toward the first chamber 21 is caused to be conductive via a check valve 61 and the operation valve 62.

2 Claims, 5 Drawing Sheets

POWER TILT CYLINDER DEVICE

BACKGROUND OF THE INVENTION

1. Field of the Invention

The present invention relates to a power tilt cylinder device of a vessel propelling device or boat motor.

2. Discussion of the Background Art

Conventionally, as a power tilt cylinder device used for a vessel propelling device of an inboard or an outboard motor, etc., there has been available a cylinder device, which is provided between a vessel body and a propelling unit and in which the propelling unit is supported so as to be tilted against the vessel body by supplying a pressure fluid to or discharging a pressure fluid from the cylinder device. This cylinder device is composed of a cylinder, a piston rod inserted into this cylinder and extended to the outside of the cylinder via a rod guide, a piston fixed on a piston rod end part inside the cylinder for plotting and forming a first chamber of a piston rod housing side and a second chamber of a piston rod non-housing side in the cylinder and a free piston for plotting the second chamber into a piston side space and an opposite piston side space.

In the power tilt cylinder device, an upper limit position is decided by the contact of the piston with the rod guide during upward tilting, which is carried out for supplying a pressure fluid discharged from a pump to the second chamber. During this period, it is necessary to control an increase in the inner pressure of the cylinder in order to protect the cylinder.

In the conventional technology for controlling an increase in the inner pressure of the cylinder during a upward tilting operation, there is available a technology, whereby in the case of a hydraulic circuit with no free pistons provided in the second chamber of the cylinder, an opening/closing valve for connecting the first and second chambers to each other and an operating member for opening this opening/closing valve are arranged in the piston, the operating member is pressed and moved by being brought into contact with the rod guide during upward tilting and operates to open the opening/closing valve of the piston, and thus the first and second chambers are caused to be communicated with each other. According to this technology, when the operating member is brought into contact with the rod guide provided in the piston in the upper limit position of upward tilting, the opening/closing valve is opened and thereby the first and second chambers are caused to be communicated with each other. As a result, the fluid, which has been supplied to the second chamber, flows away to the first chamber, and this is then discharged from the first chamber and an increase in the inner pressure of the cylinder can be controlled. However, in this conventional technology, if a free piston is provided in the second chamber of the cylinder, even when the opening/closing valve of the piston is opened, and flowing of a fluid supplied to the opposite piston side space of the free piston in the second chamber is interrupted by the free piston, and this makes it impossible for a fluid to flow away to the first chamber side as that described above. For this reason, a free piston cannot be provided.

Furthermore, in the foregoing conventional technology, a shock valve is provided in the piston. When the pressure of the first chamber of the cylinder suddenly increases, which occurs, for instance during rapid upward movement of a propelling unit period caused by a collision between the running propelling unit and an underwater obstacle, this shock valve serves to cause this hydraulic fluid to escape from the first chamber to the second chamber. However, a return valve for returning the hydraulic fluid from the second chamber to the first chamber after such a collision cannot be provided in the piston. This is because if such a return valve is provided in the piston, which does not have any free pistons, a hydraulic fluid supplied to the second chamber for upward tilting flows away through the return valve to the first chamber and this makes it impossible to perform upward tilting. That is, this conventional technology is disadvantaged by the fact that since a return valve cannot be provided in the piston, the propelling unit cannot return to its original position immediately after the upward movement caused by its collision with an obstacle.

Efforts were made to eliminate this disadvantage. For example, there was disclosed a device in Japanese Unexamined Patent Publication (JP-A) No. 60-1097, in which a free piston is provided in the second chamber of the cylinder and the piston is equipped with both shock and return valves. According to this device, since the piston has the return valve, the propelling unit can return to its original position immediately after the upward movement caused by its collision with an obstacle.

However, in a power tilt cylinder device like that disclosed in Japanese Unexamined Patent Publication (JP-A) No. 60-1097, as described above, it is impossible to control an increase in the inner pressure of the cylinder by providing in the piston an opening/closing valve, which is opened in the upper limit position of upward tilting for causing the first and second chambers to be communicated with each other, and causing a hydraulic fluid to escape from the second to the first chamber.

Therefore, in the conventional technology described in this Japanese Unexamined Patent Publication (JP-A) No. 60-1097, in a duct line for interconnecting a pump and the second chamber, a relief valve for escaping the inner pressure increase of the second chamber during upward tilting to a reservoir is provided. It is necessary to set the opening pressure of this relief valve to a pressure higher than that of the second chamber in order that the valve may not be opened by the pressure of the second chamber during upward tilting (pump discharging pressure) and the normal running position of the propelling unit may be stably maintained. Therefore, each time upward tilting reaches its upper limit position, the relief valve is opened after the discharging pressure of the pump increases to exceed the high opening pressure of the relief valve. As a result, improvements are required in terms of power consumption and pump durability.

SUMMARY OF THE INVENTION

An object of the present invention to provide a free piston and to quickly control an increase in the inner pressure of a cylinder in the upper limit position of upward tilting in a power tilt cylinder device.

In accordance with an aspect of the invention, a power tilt cylinder device is provided between a vessel body and a propelling unit. The propelling unit is supported so as to be tilted against the vessel body by supplying a hydraulic fluid from a pressure supplying device to the cylinder device and alternatively discharging a hydraulic fluid from the cylinder device. The cylinder device has a cylinder, a piston rod inserted into this cylinder and extended to the outside of the cylinder via a rod guide, a piston fixed in a piston rod end part in the cylinder for plotting and forming a first chamber of a piston rod housing side and a second chamber of a piston rod non-housing side, and a free piston for plotting the second chamber into a piston side space and an opposite piston side space. The piston is provided with a shock valve which is opened when the first chamber is suddenly compressed, and a return valve for returning a fluid in the piston side space to the first chamber by a dead weight of the propelling unit. A rod part projectingly provided in an end surface of the piston facing the second chamber is fitted in a through-hole of the free piston. A check valve for preventing flowing of a fluid from the first chamber is provided in a portion facing the opposite piston side space. An operation valve for preventing flowing of a fluid from the second chamber is provided in an end surface of the piston, which faces the first chamber, and these check and operation valves are in communication with each other. A hydraulic fluid is supplied to the opposite piston side space of the free piston, in an upper limit position of upward tilting for discharging the hydraulic fluid from the first chamber. The operation valve is pushed open by the rod guide, and a flow passage directed from the opposite piston side space of the free piston toward the first chamber is caused to be conductive via the check and operation valves.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to limit the present invention.

In the drawings.

DESCRIPTION OF THE PREFERRED EMBODIMENTS

Figure 5:
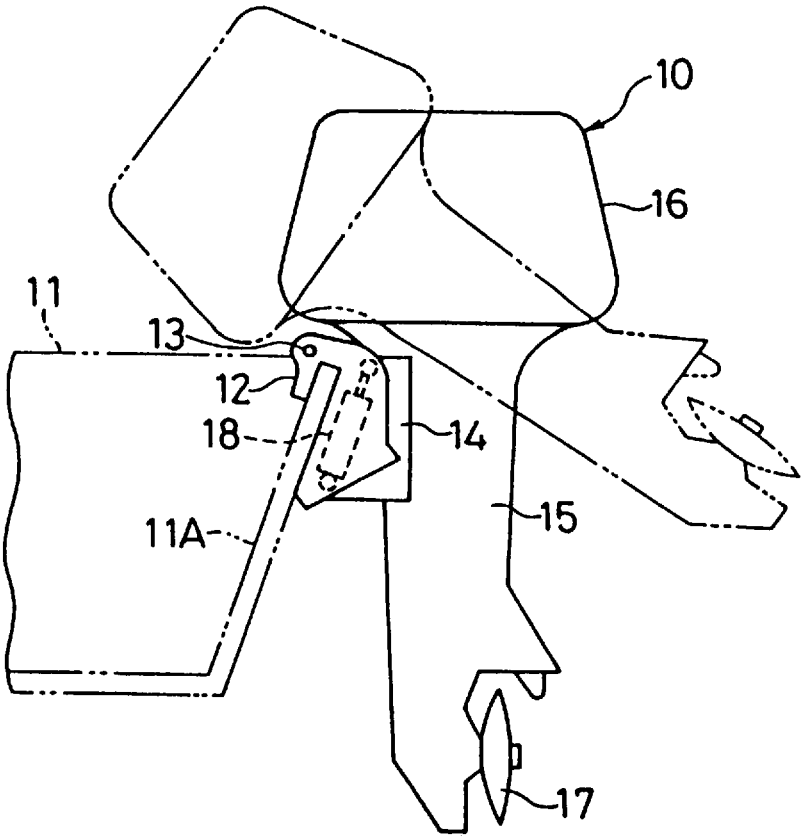
FIG. 5 is a typical view showing a vessel propelling device.

As shown in FIG. 5, a clamp bracket 12 is fixed in the stern plate 11A of a vessel or boat body 11, and a swivel bracket 14 is pivotally attached to the clamp bracket 12 via a tilt shaft 13 so as to be tilted approximately around a horizontal axis, that is, to be tilted up and down. A propelling unit 15 is pivotally attached to the swivel bracket 14 via a steering shaft, not shown, so as to be rotated around the steering shaft. An engine unit 16 is placed on the upper part of the propelling unit 15, and a propeller 17 is provided in the lower part of the propelling unit 15. An outboard motor 10 causes the propelling unit 15 to be tilted by a tilt cylinder device 100, described below.

The base end part of the cylinder 18 of the tilt cylinder device 100 is connected to the clamp bracket 12 by a pin, and the tip part of a piston rod 19, which is inserted into the cylinder 18 and extended to the outside of the cylinder 18 via a rod guide 18A, is connected to the swivel bracket 14 by a pin. The inside of the cylinder 18 is plotted into the first chamber 21 of a piston rod 19 housing side and the second chamber 22 of a piston rod 19 non-housing side by a piston 20, which is fixed in the end part of the piston rod 19.

During this period, in the tilt cylinder device 100, the piston 20 is fitted in the cylinder inner end small diameter part of the piston rod 19, and the piston 20 is fixed via a spacer ring 28 to the piston rod 19 by a piston nut 27, which is engaged with the cylinder inner end small diameter part of this piston rod 19. The cylinder inner end small diameter part of the piston rod 19 penetrates the piston 20, and its tip rod part 19A is projectingly provided in the end surface of the piston 20, which faces the second chamber 22 (rod part 19A can be replaced by a rod part, which is integral with the piston 20). The piston 20 has an O ring 29A in its sliding part, which comes into contact with the cylinder 18, and O rings 29B and 29C in its engaging part with the piston rod 19.

A shock valve 23 and a return valve 24 are arranged side by side in the piston 20. The shock valve 23 is closed by a spring 23A, and opened when a pressure inside the first chamber 21 abnormally increases, which occurs under the influence of an impact force given by collision with an underwater obstacle, and the increased pressure exceeds a specified pressure value. This makes it possible to transfer hydraulic fluid in the first chamber 21 to the second chamber 22 (piston side space 22A). The return valve 24 is opened when a pressure inside the second chamber 22 (piston side space 22A) exceeds a specified pressure value under the influence of the dead weight of the upward tilted propelling unit 15 after the impact force given by the collision with the underwater obstacle has been absorbed.

A free piston 25 is arranged close to the piston 20 in the second chamber 22. The free piston 25 plots the second chamber 22 into a piston side space 22A and an opposite piston side space 22B. During this period, the free piston 25, which has a center through-hole 25A, enables the rod part 19A of the piston rod 19 to be fitted in this through-hole 25A. The free piston 25 has an O ring 29D in its sliding part, which comes into contact with the cylinder 18, and an O ring 29E in the engaging part of the rod part 19A. The free piston 25 stays in a fixed position by a friction force, etc., between the O ring 29D provided in the free piston 25 and the inner surface of the cylinder 18 before and after the absorption of an impact, which arises due to the collision with the underwater obstacle, and thus the amount of hydraulic fluid transferred from the first chamber 21 through the shock valve 23 to the second chamber 22 (piston side space 22A) and the amount of hydraulic fluid returned from the second chamber 22 (piston side space 22A) through the return valve 24 to the first chamber can be made the same. The returning position of the piston rod 19 with respect to the cylinder 18 after the absorption of the impact can be matched with the staying position of the same before the absorption of the impact.

Next, the operation circuit of the foregoing tilt cylinder device 100 will be described. 31 represents a reservoir, which can store hydraulic fluid. 32 represents a reversible type DC motor and 33 a reversible type gear pump. The pump 33 can be selectively rotated forward or backward by the motor 32. 34 represents an opening/closing device, which has a shuttle piston 35, a first check valve 36 and a second check valve 37. A first shuttle space 38 is formed in the first check valve 36 side of the shuttle piston 35, and a second shuttle space 39 is formed in the second check valve 37 side of the same. That is, the first check valve 36 is opened by fluid pressure, which is supplied via a duct line 42 during the forward rotation of the pump 33, and the second check valve 37 is opened by fluid pressure, which is supplied via a duct line 43 during the backward rotation of the pump 33. The shuttle piston 35 operates so as to open the second check valve 37 by means of fluid pressure, which arises because of the forward rotation of the pump 33 and the first check valve 36 by means of fluid pressure, which arises because of the backward rotation of the pump 33.

The first check valve 36 of the opening/closing device 34 and the second chamber 22 (opposite piston side space 22B) of the cylinder 18 communicate with each other by a duct line 44. Also, the second check valve 37 of the opening/closing device 34 and the first chamber 21 of the cylinder 18 communicate with each other by a duct line 45.

A check valve 48 is provided in the middle part of a duct line 42A, which is linked to the duct line 42. More particularly, when the piston rod 19 of the cylinder 18 reaches a maximum shrinking position and no fluid is returned from the second chamber 22 of the cylinder 18 to the pump 33 during the tilting-down operation of the outboard motor 10, if the pump 33 is to operate, the check valve 48 is opened, and thereby hydraulic fluid can be supplied from the reservoir 31 to the pump 33.

A check valve 49 is provided in the middle part of a duct line 43A, which is linked to the duct line 43. More particularly, the inner capacity of the cylinder 18 increases by an amount equivalent to the leaving capacity of the piston rod 19 from the cylinder 18 during the upward tilting operation of the outboard motor 10, and this results in the shortage of the circulation amount of hydraulic fluid. Thus, the check valve 49 is opened and fluid can be supplied from the reservoir 31 to the pump 33 to compensate for the shortage of the circulation amount.

A down relief valve 50 is connected to the middle part of the second duct line 43 via a duct line 43B. More particularly, the capacity of the cylinder 18 decreases by an amount equivalent to the entering capacity of the piston rod 19 into the cylinder 18 during the downward tilting operation of the outboard motor 10, and this results in the surplus of the circulation amount of hydraulic fluid. Thus, the down relief valve 50 is opened and fluid having been discharged from the pump 33 can be returned to the reservoir 31.

A relief valve 51 for the second chamber is connected to the middle part of the second duct line 44. More particularly, when the propelling unit 15 collides with an underwater obstacle and a pressure in the second chamber 22 of the cylinder 18 abnormally increases during backward sailing, in which the propelling unit 15 is held in an optional upper position, the relief valve 51 for the second chamber is opened and thereby pressure increased hydraulic fluid can be returned to the reservoir 31.

A manual valve 52 is provided via a bypass duct line 46 between the first duct line 45, which is communicated with the first chamber 21 of the cylinder 18, and the second duct line 44, which is communicated with the second chamber 22. More particularly, the first and second chambers 21 and 22 of the cylinder 18 can be communicated with each other by opening the manual valve 52 and the piston rod 19 is manually extended or contracted. Thereby, the propelling unit 15 can be freely swung between its lower position and its maximum tilted-up position.

In order to protect the cylinder 18 by causing hydraulic fluid to the second chamber 22 to escape in the tilted-up upper position of the outboard motor 10, the tilt cylinder device 100 has a structure described below.

A check valve 61 for preventing flowing of a hydraulic fluid from the first chamber 21 is provided in a portion, which is fitted in the through-hole 25A of the free piston 25 and faces the opposite piston side space 22B, in the rod part 19A of the piston rod 19 projectingly provided in the end surface of the piston 20 facing the second chamber 22 by penetrating the piston 20. 61A represents a spring for closing the check valve 61. An operation valve 62 for preventing flowing of the hydraulic fluid from the second chamber 22 is provided in the end surface of the piston 20, which faces the first chamber 21. 62A represents a spring for closing the operation valve 62, and 63 represents the projecting operation part of the operation valve 62, which projects from the piston end surface. Furthermore, the check valve 61 and the operation valve 62 are communicated with each other by a flow passage 64, which is provided in the piston rod 19 and the piston 20.

Therefore, during the upward tilting of the tilt cylinder device 100, a hydraulic fluid is supplied to the opposite piston side space 22B of the free piston 25, and when the piston 20 comes into contact with the rod guide 18A in the upper limit position of upward tilting, which is performed for discharging the hydraulic fluid from the first chamber 21, the operation valve 62 is pushed open by the rod guide 18A. In this manner, the flow passage 64 directed from the opposite piston side space 22B of the free piston 25 toward the first chamber 21 is caused to be conductive via the check valve 61 and the operation valve 62. Consequently, the pressurized fluid, which has been supplied to the opposite piston side space 22B of the second chamber 22, escapes through the flow passage 64 to the first chamber 21, and is then discharged to the outside of the cylinder 18.

When the tilt cylinder device 100 performs tilting down from the upper limit position of upward tilting, the hydraulic fluid supplied to the first chamber 21 closes the return valve 24 of the piston 20 and presses down the piston 20.

Next, the operation of the tilt cylinder device 100 will be described.

(Upward tilting operation)

The upward tilting operation of the outboard motor 10 is as follows.

Figure 1:
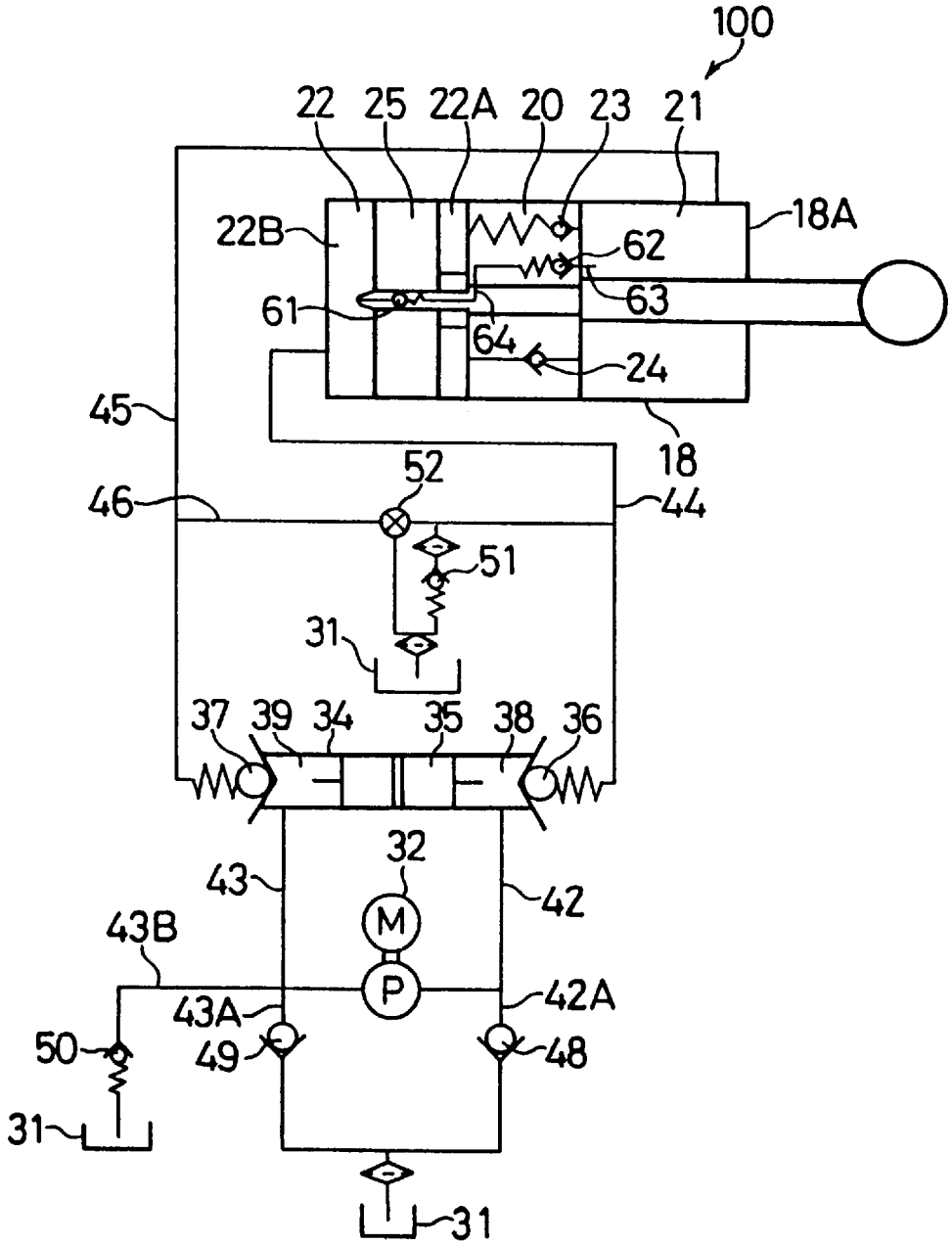
FIG. 1 is a circuit diagram showing a power tilt cylinder device.

When the motor 32 is actuated for upward tilting and the pump 33 is rotated forward, fluid discharged from the pump 33 enters the opposite piston side space 22B of the second chamber 22 of the cylinder 18 after passing through the duct line 42, the first check valve 36 and the second duct line 44, pushes up the piston rod 19 and enables the propelling unit 15 to be tilted from a lower position indicated by a solid line shown in FIG. 1 to an upper position indicated by a 2-dotted chain line. Fluid in the first chamber 21 of the cylinder 18 is returned to the pump 33 through the duct line 45, the second check valve 37 and the duct line 43.

Figure 2:
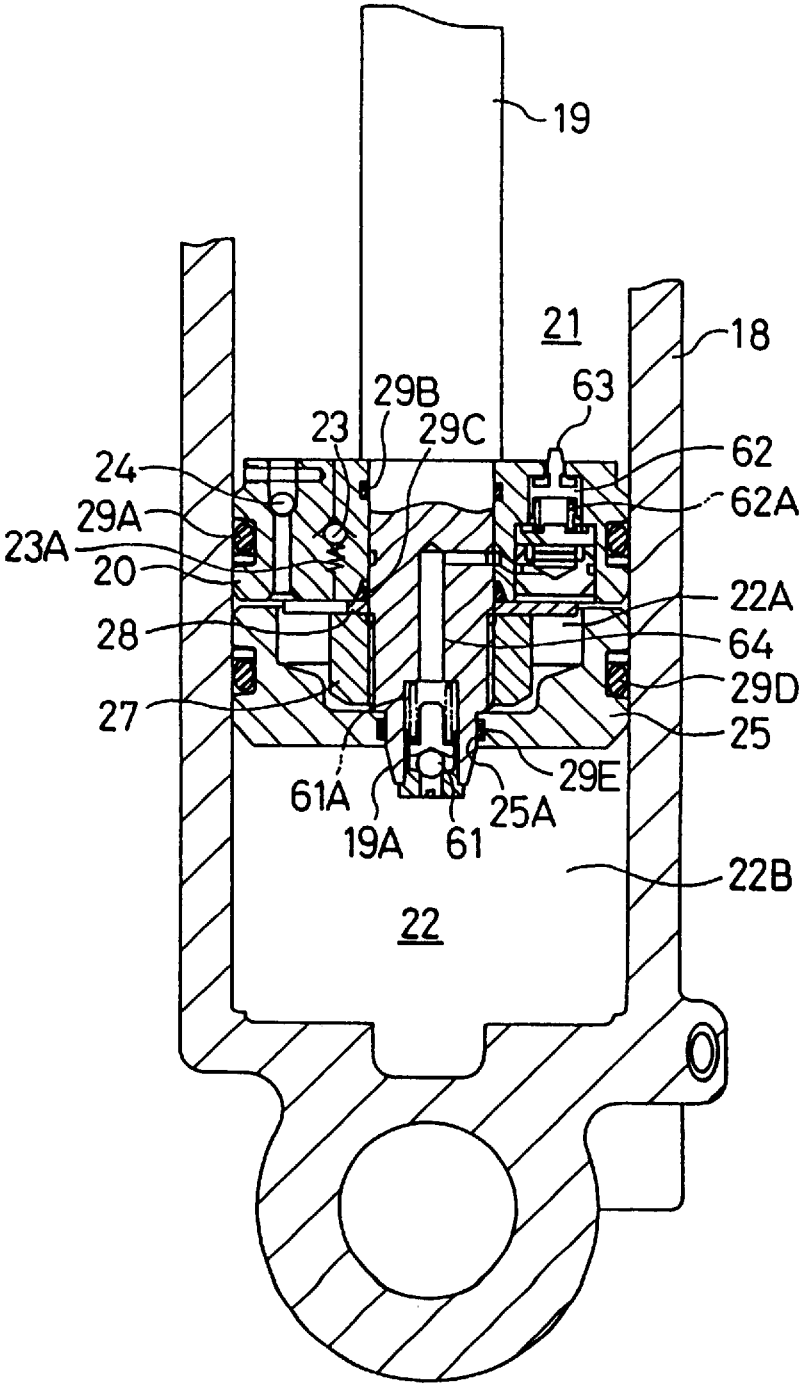
FIG. 2 is a typical view showing a normal condition of the power tilt cylinder device.

During this upward tilting period, the tip rod part 19A of the piston rod 19 is fitted, as shown in FIG. 2, in the through-hole 25A of the free piston 25. In this case, when the hydraulic fluid is supplied to the opposite piston side space 22B, the check valve 61 is opened by the upward tilting pressure of the piston rod 19. However, since the operation valve 62 is in a closing direction, the free piston 25 and the piston 20 are raised together.

In the upper limit position of upward tilting, in which the piston rod 19 reaches its maximum extended position, the operation valve 62 is pushed open by the rod guide 18A. In this manner, the flow passage 64 directed from the opposite piston side space 22B of the free piston 25 toward the first chamber 21 is caused to be conductive via the check valve 61 and the operation valve 62. Consequently, the hydraulic fluid, which has been supplied to the opposite piston side space 22B of the second chamber 22, escapes through the flow passage 64 to the first chamber 21, this is then discharged to the outside of the cylinder 18 and thereby the inner pressure increase of the cylinder 18 is controlled.

During this period, the operation valve 62 is always pushed by the piston 20 in the upper limit position of upward tilting and immediately opened. Thus, the inner pressure increase of the cylinder 18 is quickly controlled, and this makes it possible to reduce power consumption and improve pump durability.

(Downward tilting operation)

The downward tilting operation of the outboard motor 10 is as follows.

When the motor 32 is actuated for downward tilting and the pump 33 is rotated backward, fluid discharged from the pump 33 enters the first chamber 21 of the cylinder 18 after passing through the duct line 43, the second check valve 37 and the duct line 45, and presses down the piston rod 19. Fluid in the second chamber 22 of the cylinder 18 is returned to the pump 33 through the duct line 44, the first check valve 36 and the duct line 42.

During this downward tilting period, the tip rod part 19A of the piston rod 19 is fitted, as shown in FIG. 2, in the through-hole 25A of the free piston 25. In this case, when the hydraulic fluid is supplied to the first chamber 21, the operation valve 62 of the piston 20 is opened. However, since the check valve 61 is in a closing position, the fluid does not flow through the flow passage 64. The shock valve 23 of the piston 20 is not opened by the pressure at this time, and thus the piston 20 is lowered by pressurized fluid.

(Rapid upward movement or jumping-up operation)

The jumping-up operation of the outboard motor 10 following its collision with an underwater obstacle is as follows.

Figure 3:
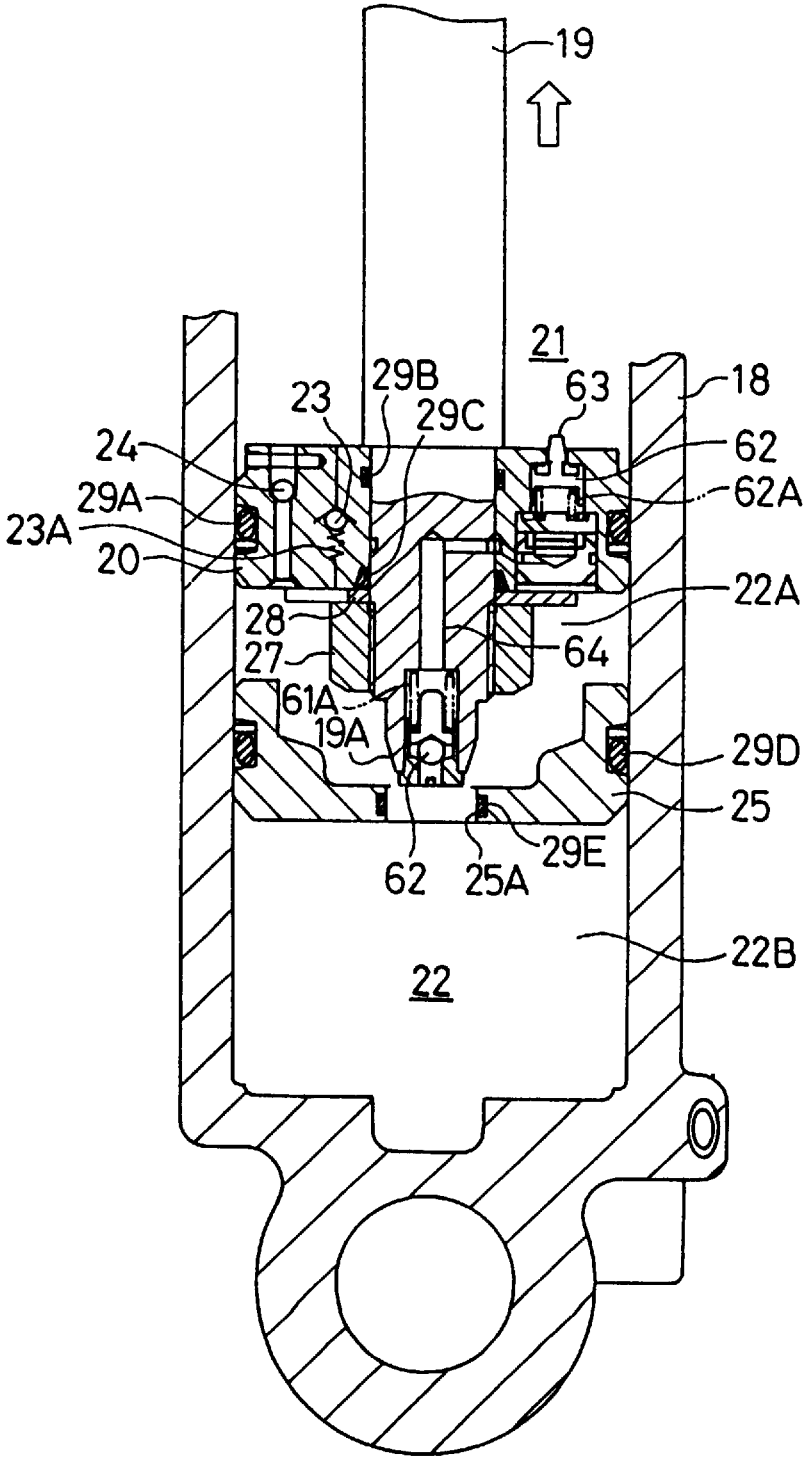
FIG. 3 is a typical view showing a upward moved position of the power tilt cylinder device, which occurs due to an impact given when the device collides with an underwater obstacle.

When an underwater obstacle comes into collision with the propelling unit 15, a large tensile strength is applied on the piston rod 19, the pressure of the first chamber 21 of the cylinder 18 is increased, the shock valve 23 is opened, hydraulic fluid in the first chamber 21 is transferred to the piston side space 22A of the second chamber 22, the piston rod 19 is extended, which causes the propelling unit 15 to jump up, and an impact force is absorbed. At this time, the fitted condition of the free piston 25 and the piston rod 19 is released, as shown in FIG. 3, from the normal condition of FIG. 2, and the free piston 25 is left in its position. In the piston side space 22A between the piston 20 and the free piston 25, after the piston rod 19 leaves the cylinder 18, supplying of a fluid becomes short by an amount equivalent to the piston rod leaving volume, and thus a negative pressure condition is created.

Figure 4:
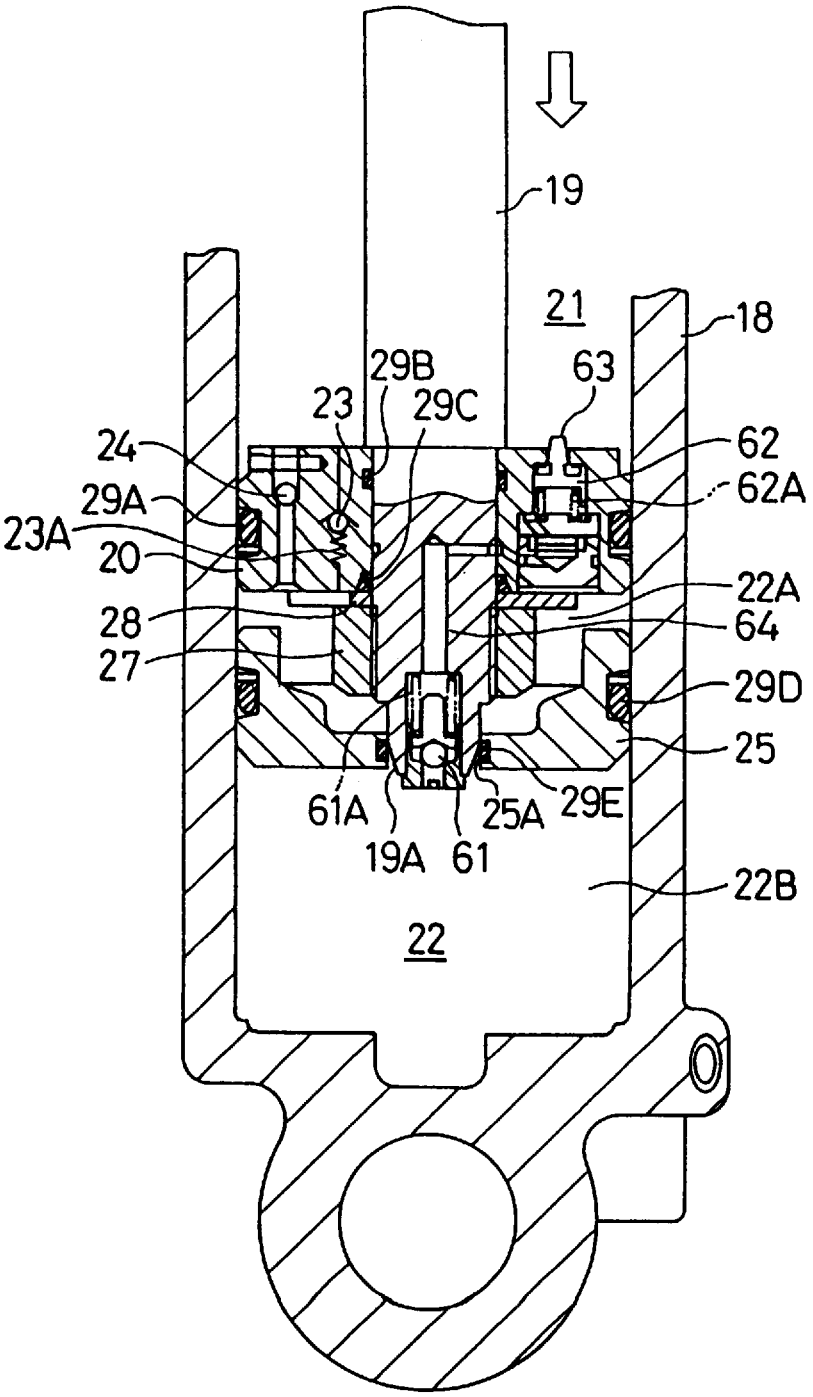
FIG. 4 is a typical view showing a returning condition of the power tilt device after its upward movement.

After the absorption of the impact force, a pressure in the piston side space 22A is increased by the dead weight of the propelling unit 15, the return valve 24 is then opened, the hydraulic fluid in the piston side space 22A is returned to the first chamber 21, and the propelling unit 15 is returned to a position before its jumping up by contracting the piston rod 19. In this manner, the tip rod part 19A of the piston rod 19 is fitted, as shown in FIG. 4, in the through-hole 25A of the free piston 25. From this condition, the tip rod part 19A of the piston rod 19 enters the opposite piston side space 22B, the free piston 25 is raised to the piston 20 side by an amount equivalent to the entering volume of the tip rod part 19A, and the normal condition of FIG. 2 is achieved.

Furthermore, as described above, in this embodiment, the free piston 25 is provided in the second chamber 22. Thus, the amount of hydraulic fluid transferred from the first chamber 21 to the second chamber 22 and the amount of the hydraulic fluid returned from the second chamber 22 to the first chamber 21 are the same before and after the impact absorption. Thereby, the returning position of the piston rod 19 after the impact absorption can be matched with its lower position before the impact absorption.

Apparent from the foregoing, according to the present invention, in the power tilt cylinder device, the free piston is provided and it is possible to quickly control the inner pressure increase of the cylinder in the upper limit position of upward tilting.

The entire disclosure of Japanese Patent Application No. 8-91755 filed on Mar. 22, 1996 including specification, claims, drawings and summary are incorporated herein by reference in its entirety.

While there has been described a preferred embodiment of the invention with reference to the accompanying drawings, it is to be understood that a specific constitution of the invention is not limited to this embodiment and various modifications are possible without departing from the spirit and scope of the invention, and it is intended to cover in the appended claim all such modifications as fall within the invention.

What is claimed is:

1. A power tilt cylinder device provided between a vessel body and a vessel propelling unit, the propelling unit being supported so as to be tilted against the vessel body by supplying a hydraulic fluid from a pressure supplying device to the cylinder device and alternatively discharging a hydraulic fluid from the cylinder device, the cylinder device comprising a cylinder; a piston rod, which is inserted into this cylinder and extended to the outside of the cylinder via a rod guide; a piston, which is fixed in a piston rod end part in the cylinder and plots and forms a first chamber of a piston rod housing space and a second chamber of a piston rod non-housing space; and a free piston, which plots the second chamber into a piston side space and an opposite piston side space, said piston being provided with a shock valve, which is opened when the first chamber is suddenly compressed, and a return valve, which returns a fluid in the piston side space to the first chamber by a dead weight of the propelling unit, a rod part projectingly provided in an end surface of the piston facing the second chamber is fitted in a through-hole of the free piston, a check valve for preventing flowing of a fluid from the first chamber is provided in a portion facing the opposite piston side space, of said rod part provided in the piston, an operation valve for preventing flowing of a fluid from the second chamber is provided in an end surface of the piston, which faces the first chamber, and these check and operation valves being communication with each other, a hydraulic fluid supplied to the opposite piston side space of the free piston, in an upper limit position of upward tilting for discharging the hydraulic fluid from the first chamber, said operation valve is pushed open by the rod guide, and a flow passage directed from the opposite piston side space of the free piston toward the first chamber is caused to be conductive via said check and operation valves.

2. The power tilt cylinder device according to claim 1, wherein said operation valve has a projecting operation part which projects from a piston end surface and is capable of being pushed by a rod guide in the upper limit position of upward tilting.

* * * * *